United States Patent [19]

Lambrecht

[11] 4,086,038

[45] Apr. 25, 1978

[54] ROTARY PISTON MACHINE OF TROCHOIDAL CONSTRUCTION

[76] Inventor: Jürgen Hans Wilhelm Lambrecht, Max-Ruttgers Str. 29, Irschenhausen, Germany, 8026

[21] Appl. No.: 586,223

[22] Filed: Jun. 12, 1975

[30] Foreign Application Priority Data

| | | |
|---|---|---|
| Dec. 6, 1974 | Germany | 242832 |
| Mar. 5, 1975 | Germany | 251990 |

[51] Int. Cl.[2] ..... F01C 1/02; F01C 21/02

[52] U.S. Cl. ..... 418/60; 418/61 A; 418/61 B; 418/151

[58] Field of Search ..... 418/61 B, 60, 61 A, 418/151; 123/8, 45

[56] References Cited

U.S. PATENT DOCUMENTS

| | | | |
|---|---|---|---|
| 3,037,458 | 6/1962 | Olmstead et al. | 415/197 |
| 3,922,121 | 11/1975 | Garfinkle | 418/61 A |

FOREIGN PATENT DOCUMENTS

| | | | |
|---|---|---|---|
| 1,278,136 | 10/1961 | France | 418/61 B |
| 1,551,089 | 1/1970 | Germany | 418/61 B |
| 1,905,526 | 8/1970 | Germany | 418/61 B |
| 25,247 of | 1909 | United Kingdom | 418/61 B |

*Primary Examiner*—John J. Vrablik

*Attorney, Agent, or Firm*—James E. Bryan

[57] ABSTRACT

This invention relates to an improvement in a rotary piston machine of trochoidal construction having a piston mounted on an eccentric shaft in a housing delimited on both sides by side walls, said piston being rotated by a follower gearing, one part of which is rigidly connected with the piston, the improvement comprising eccentrically-rotatable shaft means in two bearing means which are eccentric with respect to each other and one of which is radially within the other, said shaft means supporting said piston and the part of the follower gearing rigidly connected therewith.

1 Claim, 11 Drawing Figures

ROTARY PISTON MACHINE OF TROCHOIDAL CONSTRUCTION

The present invention relates to a rotary piston machine of trochoidal construction having a piston mounted on an eccentric shaft within a housing delimited on both sides by side walls. The piston is rotated by a follow-up drive, one part of which is connected with the piston.

Engines of this type are generally known from the literature. A review thereof is presented, for example, in the book Rotationskolben-Verbrennungsmotoren (Rotary Piston Internal Combustion Engines), by W. D. Bensinger, Springer Verlag (Springer Publisher), Berlin-Heidelberg-New York 1973.

A rotary piston engine disclosed in German Pat. No. 1,451,761, has an eccentric shaft which is positioned in bearings in the side parts of the housing, and on which the piston is rotatably mounted. Provided therein as a guide gear is a pinion which is secured to the piston, and which meshes with an inside wheel on the housing.

Moreover it is known from German Offenlegungsschrift No. 2,261,670, to provide a rotary piston engine with a continuous shaft, and to provide thereon, mounted eccentrically and torsionally rigidly, a cylindrical rotational body which is offset by the degree of the trochoid eccentricity. Positioned on the rotational body is a sleeve on which the piston is mounted in a form-closing manner. Here again, accordingly, a bearing is provided for on the eccentric within the piston width. In an additional application, German Offenlegungsschrift No. 2,339,911, this construction is expanded to include multiple-disc machines.

All of the proposals and constructions which have become known to date specified that the piston is rotatably mounted on the eccentric shaft and that, in the simple follower by means of a pinion secured to the piston and an inside wheel secured to the housing, being preferred for reasons of cost, this support takes place on one side only.

This led to problems, since the space within the piston is limited special efforts must be undertaken for cooling the bearing in the piston, and use of these machines for tasks in which the working medium must remain oil-free is nearly impossible due to the required bearing lubrication.

It must be considered an additional disadvantage that, in the single-stage gear follower system, favored because of cost, an expensive balancing of the masses and balancing of the moments is required because of the over-hung bearing.

It is the object of the present invention to so arrange the bearing of the piston within the housing that the problems relating to cooling, lubrication, and balancing are significantly improved.

This object is obtained, in accordance with the present invention, by virtue of the fact that the piston and the part of the follower gearing rigidly connected therewith are supported in the housing by way of an eccentrically-rotatable journaled shaft by means of two bearings radially positioned within each other and arranged eccentrically with respect to each other. This solution is independent of whether what is involved is a rotary piston machine with a trochoidally-shaped housing and a piston provided as the inner envelope curve, or whether the piston has the shape of a trochoid and the housing is provided as the outer envelope curve.

It is understood that the mathematically exact trochoids and envelope curves may be replaced, as is presently customary in practice, by parallel curves, so-called equidistants, without detracting from the inventive concept.

Eccentric bearings have so far become known, for example, in printing presses (DAS No. 1,227,916). Furthermore, it is known — in connection with radial anti-friction bearings — to provide the inner bearing ring with an eccentrically-positioned bore. The installation of such bearings was limited to a few cases of application, since undesirable eccentric masses were thereby created that were difficult to counterbalance. In contrast thereto, the subject matter of the present invention effectively makes use of this property of the eccentric bearings, and supports the eccentrically-rotatable shaft of a rotary piston machine, thereby improving the balancing of the machine and facilitating the cooling and lubrication thereof.

In an advantageous development of the present invention, the piston and the part of the follower gearing rigidly connected therewith are non-rotatably seated on an eccentrically-rotatable shaft which is rotatably mounted eccentrically with respect to the center line of the machine.

According to one embodiment of the present invention, the pivot of the eccentrically-rotatable shaft is positioned in an eccentric disc.

According to another embodiment of the invention, each bearing point of the eccentrically-rotatable shaft is positioned in one eccentric disc each.

The drive or the power take-off of the machine takes place advantageously over at least one of the eccentric discs. It is readily possible, in this connection, to also transmit a drive-through output.

According to a preferred embodiment of an inventive rotary piston machine, at least one of the eccentric discs is continued as a shaft central to the main machine axis.

In a further development of the inventive concept, the circumference of at least one of the eccentric discs, being central to the main axis, is provided as a drive pulley or driven pulley, or a driving sprocket.

According to one embodiment of the present invention, the follower operation of the piston in the housing is accomplished with a thrust crank gear with crosshead guides pointing in two directions. In a simplified version, only one thrust crank gear is provided with one crosshead guide for the follower operation.

The eccentrically-rotatable shaft is advantageously supported at least at one point by the thrust crank gear with crosshead guides pointing in two directions.

For specific cases of application, it is advantageous that the bearing points for the eccentrically-rotatable shaft be positioned on one side of the piston. For other applications it has been found to be favorable that the piston be supported on both sides and at least one bearing point for the eccentrically-rotatable shaft be positioned on each side of the piston.

According to another embodiment of the present invention, two pistons are mounted in tandem in the axial direction, and an eccentric disc is positioned therebetween. In this case, the shaft journals of the two pistons may be angularly positioned and offset with respect to each other in the eccentric disc.

According to still another embodiment of the present invention, several pistons may be mounted side-by-side in any desired phase relationship.

Furthermore, oil splash discs may be provided on the eccentrically-rotatable shaft.

In an advantageous embodiment of an inventive rotary piston machine, a coolant circuit is provided for the piston in which circuit the coolant is fed into the piston through bores in the eccentrically-rotatable shaft and flows back by way of other bores.

Finally it is possible, according to another embodiment of the present invention, to provide the side walls of the working chambers, between which the pistons move, double-walled, and to evacuate the interstice between the double walls.

All machines proposed according to the present invention may be balanced exactly. The eccentric discs may be used for the purpose of balancing.

Further advantages, features, and possibilities of application of the present invention will become more apparent from the following description of the figures in the accompanying drawings, wherein FIG. 1 is a cross-sectional view of an inventive rotary piston machine of trochoidal construction;

FIG. 2 illustrates a balanced rotary piston machine of trochoidal construction with pistons mounted in tandem in the axial direction;

FIG. 2*a* illustrates a rotary piston machine in which the shaft ends of the two pistons are positioned in eccentric disc means with an angular offset;

Figure 1:
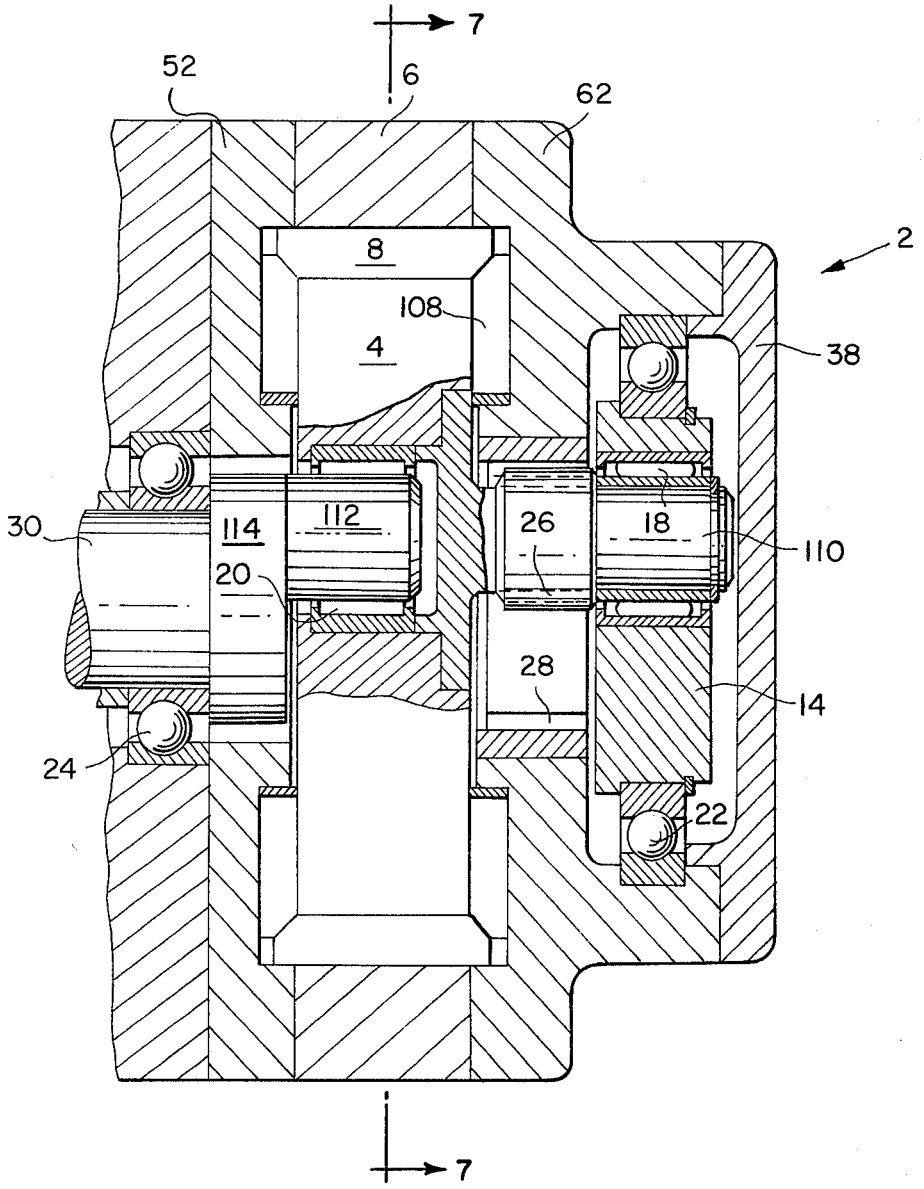
Figure 2:
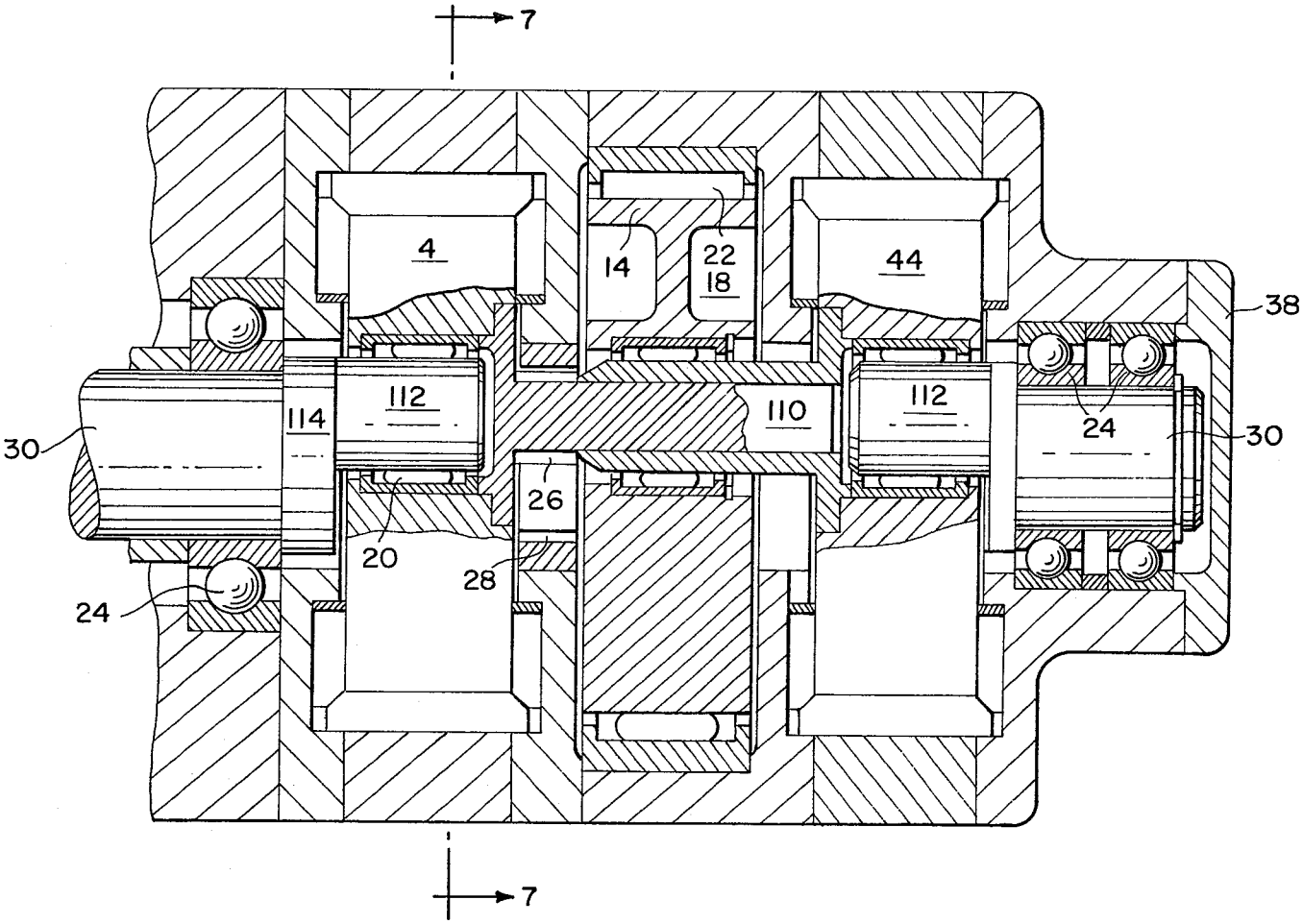
Figure 2A:
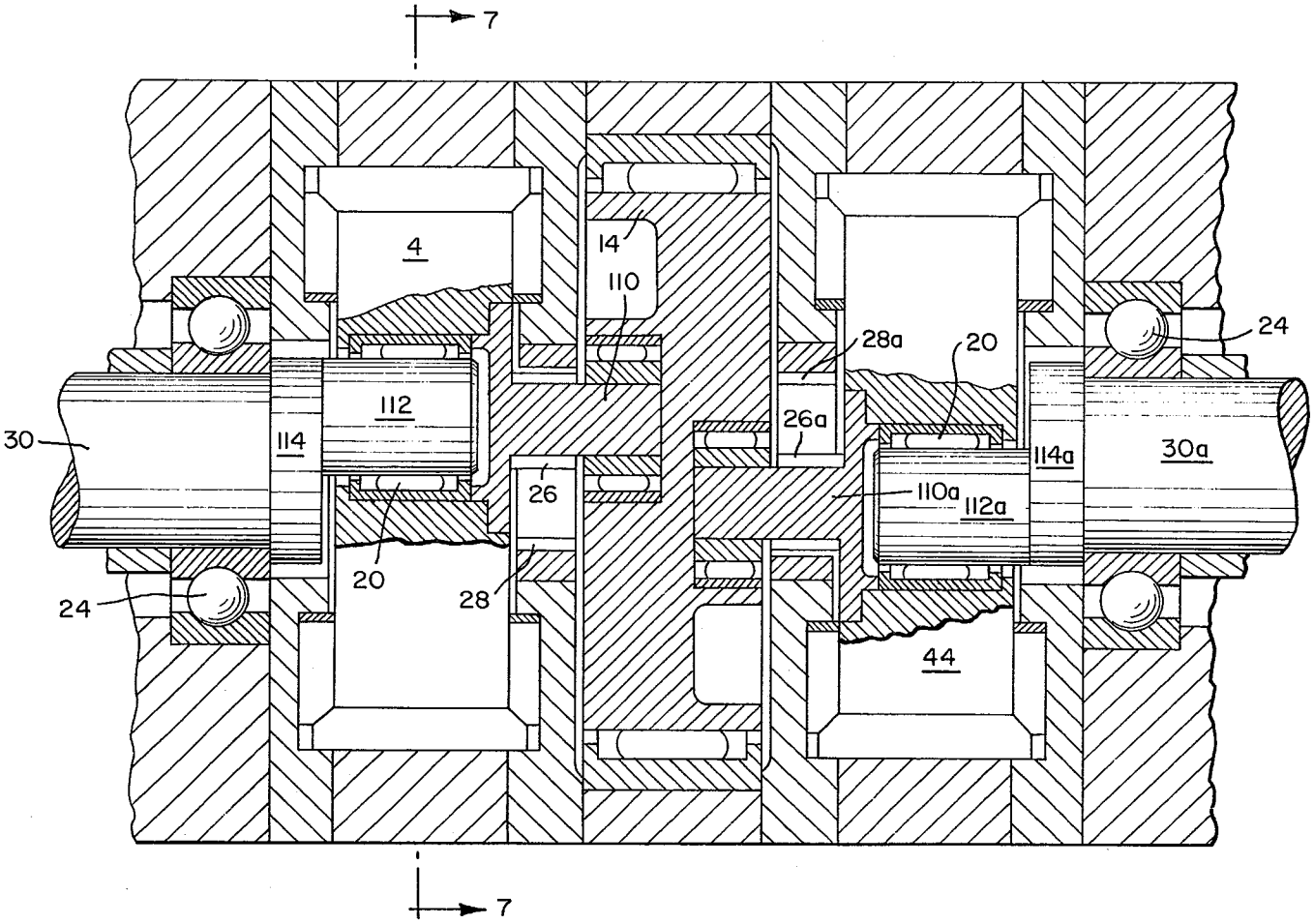
Figure 5:
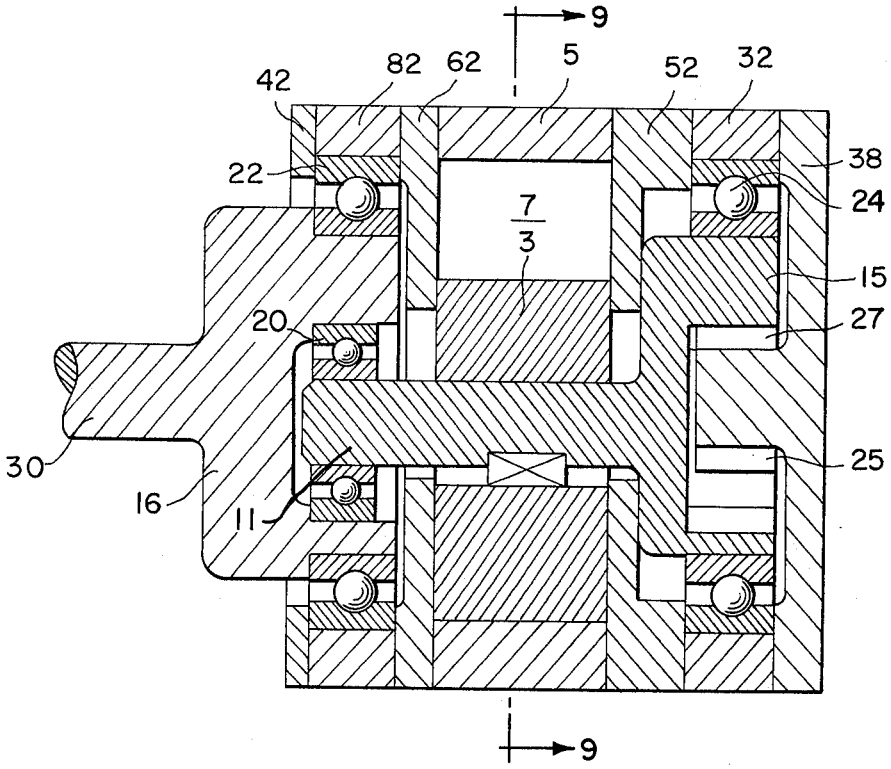
Figure 6:
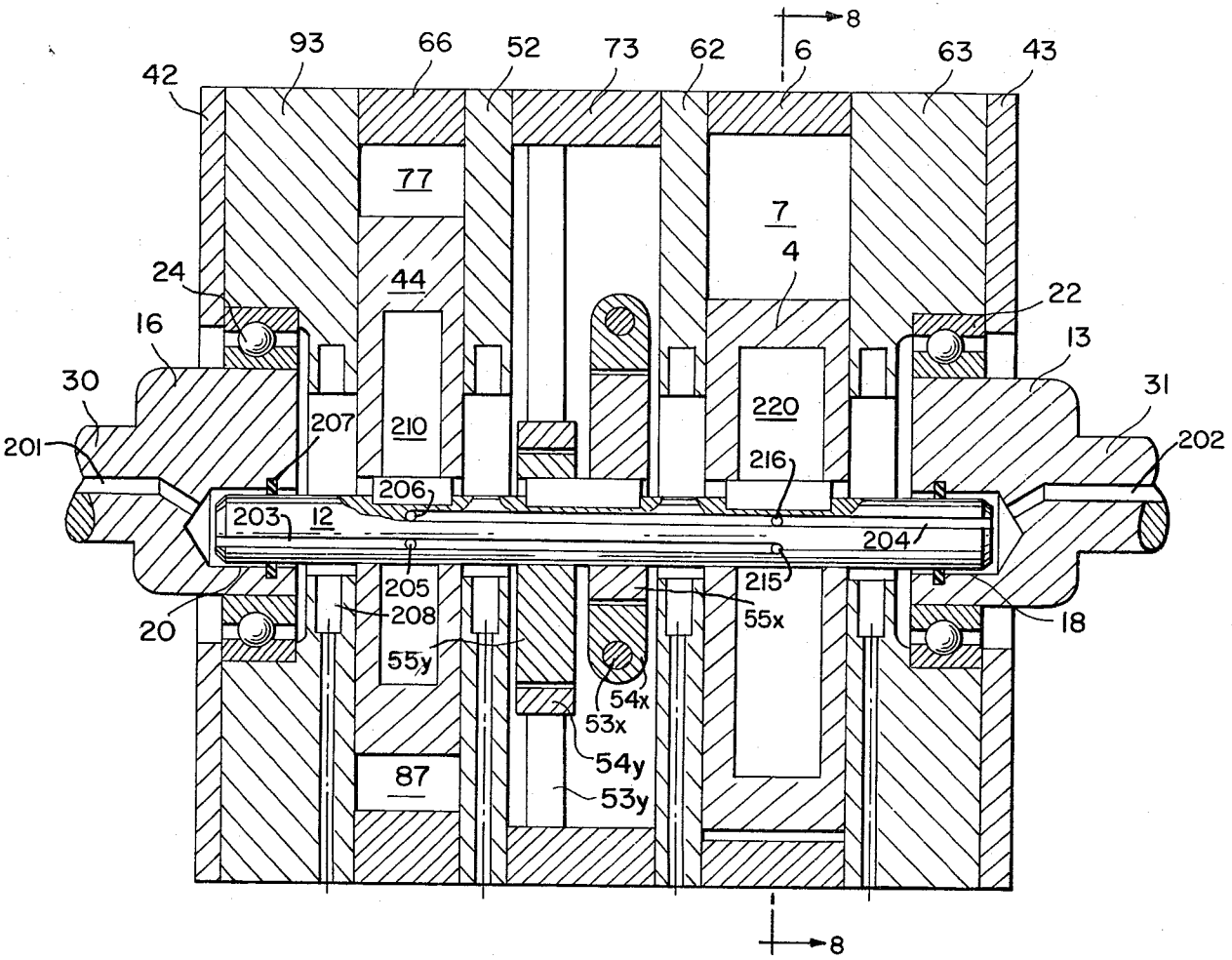
Figure 6A:
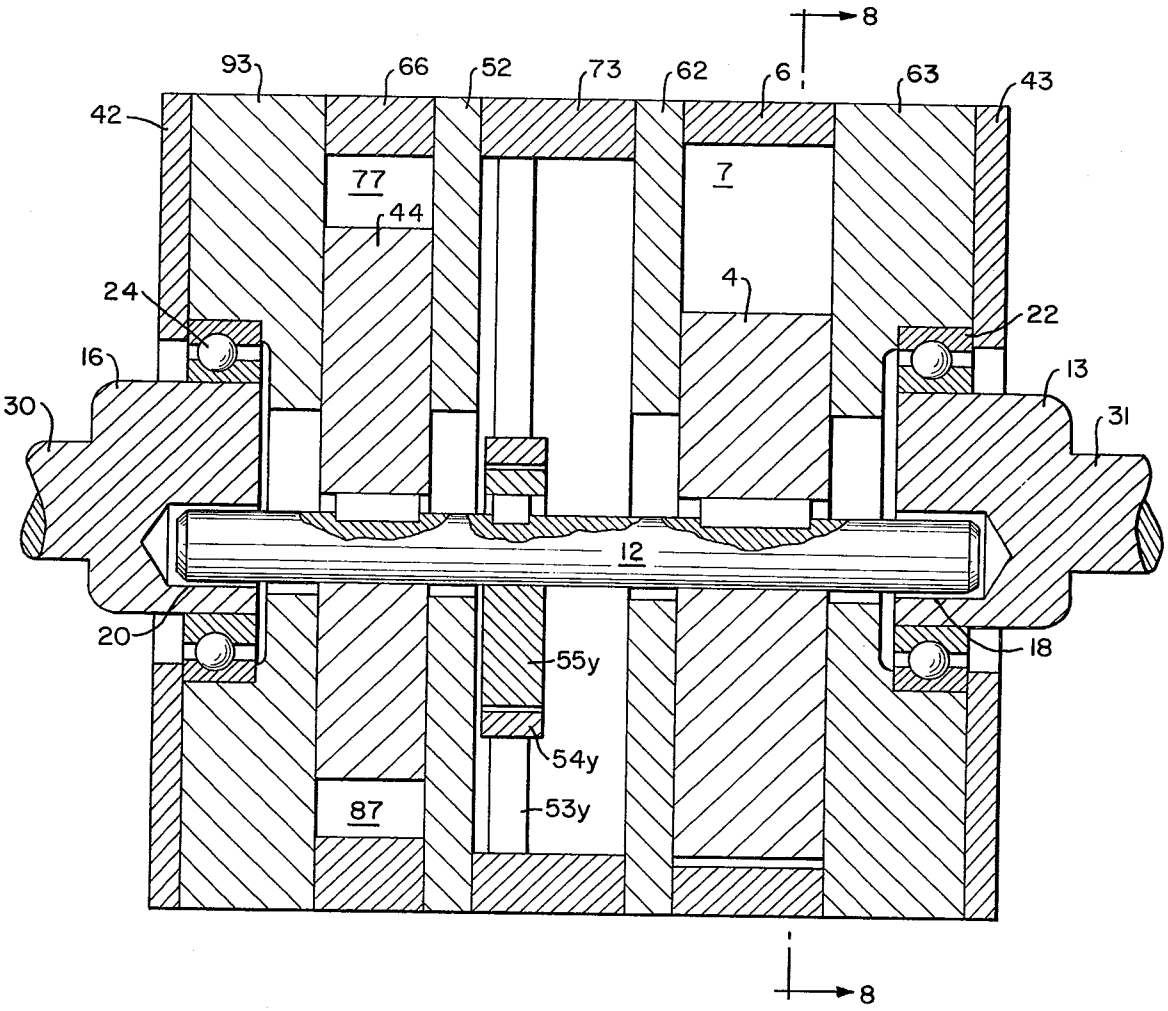
Figure 7:
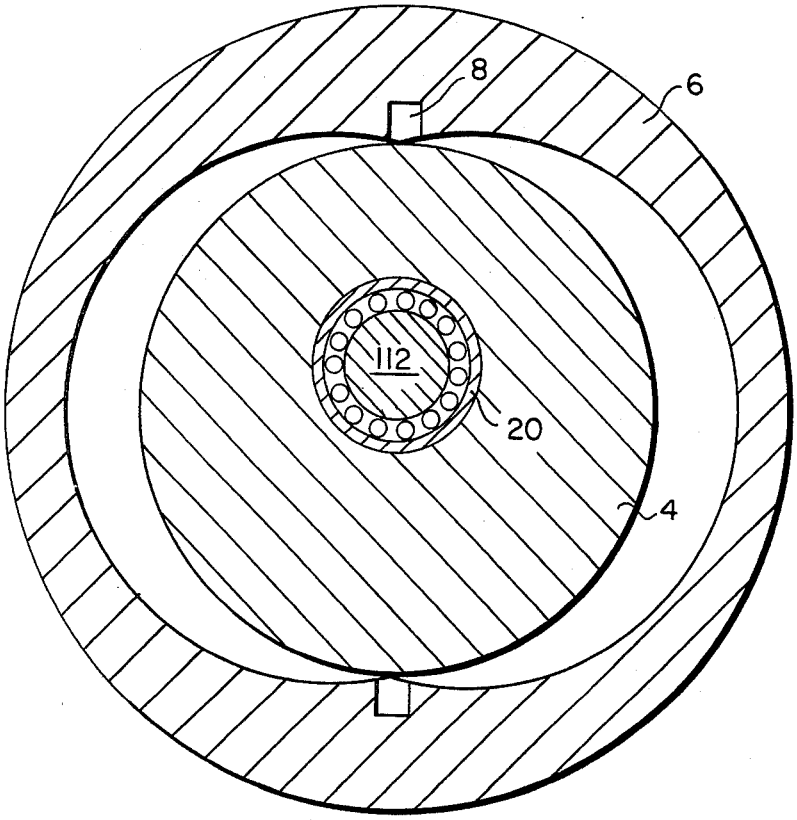

FIG. 5 illustrates an inventive machine with a trochoidally-shaped housing and a piston provided as an inner envelope curve, FIG. 6 illustrates an inventive machine with two pistons, wherein the follower operation of the pistons within the housing takes place by means of a thrust crank gear with crosshead guides pointing in two directions, and wherein the eccentrically-rotatable shaft is positioned within the thrust crank gear;

FIG. 6*a* illustrates an inventive machine in which follower gearing includes a thrust crank drive with a single crosshead guide;

FIG. 7 is a cross-sectional view taken on line 7 of FIGS. 1, 2, and 2*a;*

Figure 9:
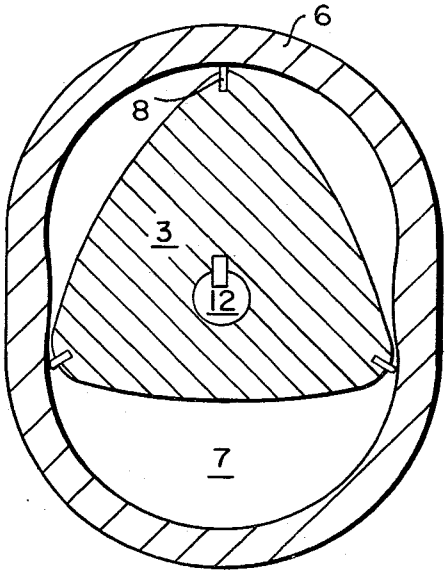
Figure 8:
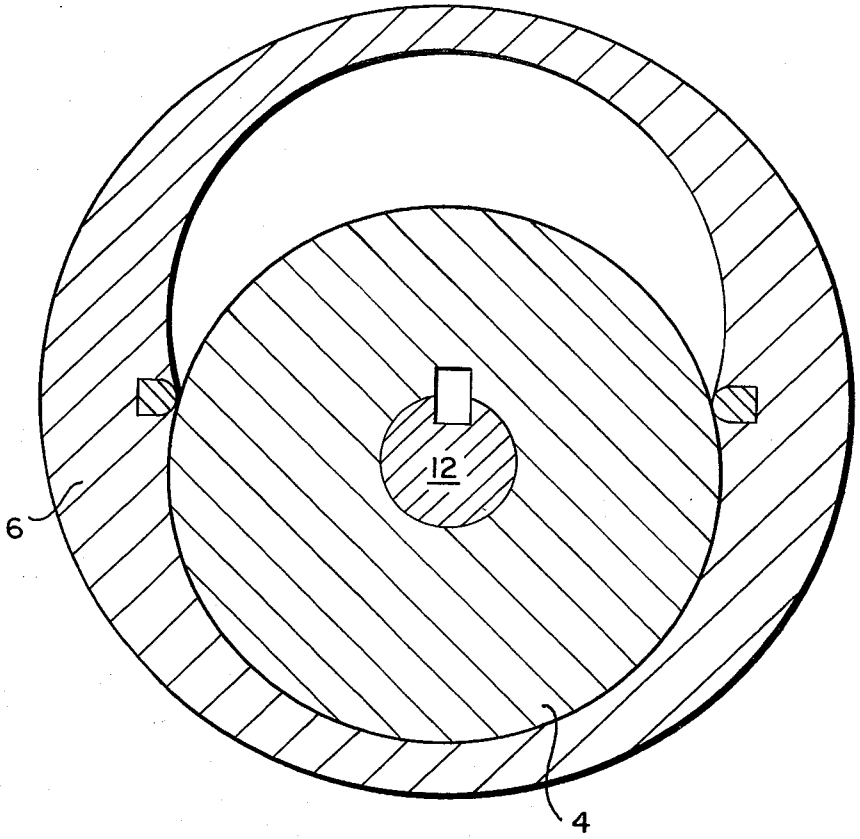

FIG. 8 is a cross-sectional view taken on line 8 of FIGS. 3, 4, 6, and 6*a;* and FIG. 9 is a cross-sectional view taken on line 9 of FIG. 5.

FIG. 1 is a cross-sectional view through a rotary piston machine 2 of trochoidal construction which is composed of a housing and a piston 4 positioned in the housing. The housing has an annular center part 6, side walls 52 and 62, and a lid 38. Positioned within the housing is a crankshaft, by means of an antifriction bearing 24. The crankshaft includes a crankshaft pin 30, a crankshaft cheek 114, and a crank pin 112. Mounted on the crank pin 112, by means of an antifriction bearing 20, is the piston 4. The sealing of the piston 4 within the housing takes place toward the central housing part by way of radial sealing strips 8 and toward the side walls 52 and 62 by way of the side sealing strips 108. The piston 4 is rigidly connected with a pinion 26 whose gear-tooth system meshes with the gear-tooth system of a gear 28 secured to the housing interior. The pinion 26 and the gear 28 constitute a single-stage gear follower system. Mounted on the pin end 110 of the pinion 26 is an antifriction bearing 18 which is fitted into the bore of an eccentric disc 14. The eccentric disc has an antifriction bearing 22 at the circumference thereof which is fitted into the bore of one side wall 62. The antifriction bearings 18 and 22 are positioned radially within each other and eccentrically with respect to each other. The mass distribution of the eccentric disc 14 is so selected that the imbalance of the piston 4 is compensated for. The eccentric disc 14 may be connected with a driven shaft (not shown) which penetrates through the lid 38.

FIG. 2 is a cross-sectional view through a rotary piston machine of trochoidal construction with two pistons 4 and 44 being mounted in tandem in the axial direction. Corresponding elements which have the same functions have been given the same reference numerals as those used in FIG. 1. It is clearly apparent that only one gear follower system 26 and 28 is required for both pistons 4 and 44, and that the eccentric disc 14 is used for the dynamic balancing of the two pistons 4 and 44. In this embodiment, the two crank pins 112 are in alignment with each other.

The embodiment shown in FIG. 2 may be modified in that the pivot 110 in the center of the eccentric disc 14 is halved, and its right-hand side half, being rigidly connected with the piston 44, is rotatably supported in an angularly-displaced position in another bore in the eccentric disc 14. In this case it is necessary, however, that an additional follower gearing be provided for the piston 44. The coordinated central housing part must be additionally turned about half the angle, in known manner.

In FIG. 2, the eccentric disc 14 positioned in the housing by means of antifriction bearings 22 constitutes at the same time a center bearing for the two pistons 4 and 44. The imbalances of the pistons 4 and 44 and of the crankshaft may be completely balanced by means of the eccentric disc.

In FIG. 2*a* both pistons 4 and 44 are made to follow in an identical manner by means of the gears 26, 28 and 26*a*, 28*a*. These pistons rest by means of the journals 110 and 110*a*, respectively, in the eccentric cam or disc and they are rotatably connected with the shafts 30 and 30*a*, respectively, by means of the journals 112 and 112*a*.

It is possible to arbitrarily rotate the center shaft of the journals 110 and 112 with respect to that of the journals 110*a* and 112*a*. In the case illustrated, the angular displacement is 180°.

FIGS. 3 to 6 illustrate a continuation of the inventive concept of the bearing of the eccentrically-rotatable shaft 110, 112, in an eccentric disc 14 in a manner such that the eccentric rotating movement is taken out from the piston and displaced onto the juxta-positioned eccentric bearing points. By virtue of this spatial separation, not only is the balancing improved, but the previous restrictions are eliminated such as they pertain to the dimensions of the bearing, to the heat supply to the bearing, and finally the need for using lubricants in the area of the piston width. The form-locking connection between the piston and the eccentrically-rotatable shaft allows moreover pumping of coolant through the piston without difficulties, such as is indicated also in the embodiments of FIGS. 1 and 2.

Figure 3:
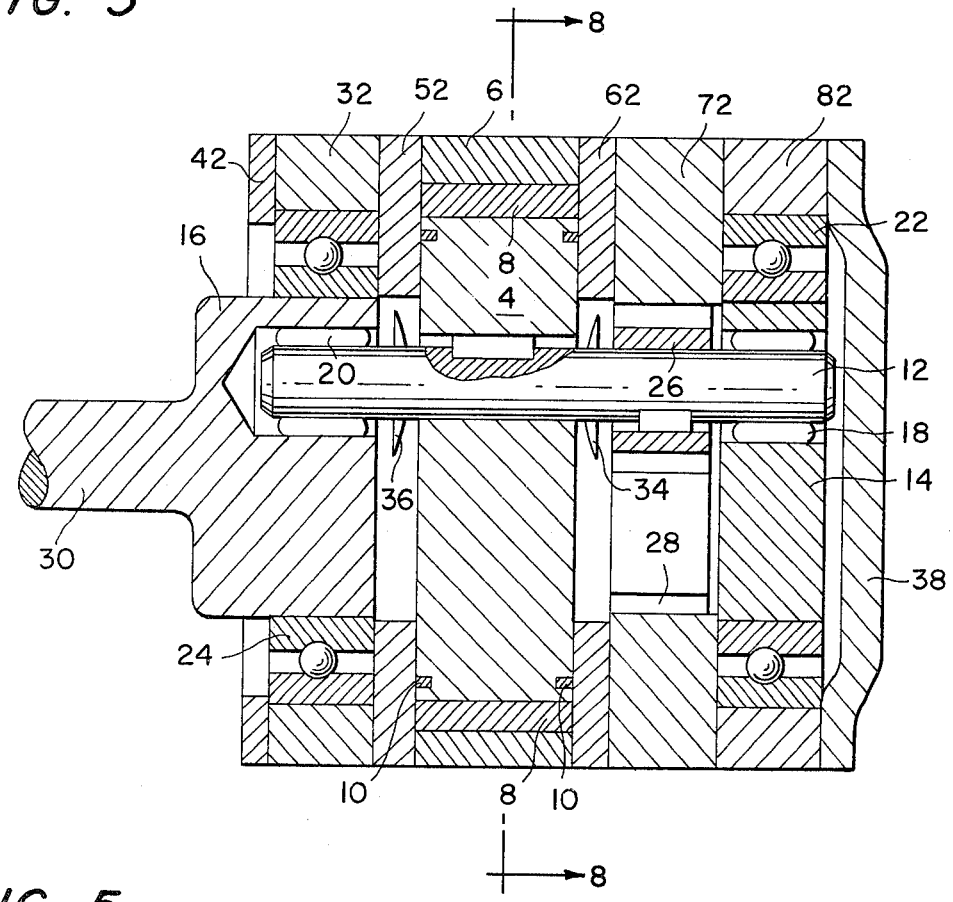
FIG. 3 illustrates the inventive construction of a rotary piston machine of trochoidal construction with a housing provided as an outer envelope curve, wherein eccentric discs are mounted on both sides of the piston.

FIG. 3 shows, in a greatly simplified illustration, the construction of a further inventive rotary piston machine of trochoidal construction. Also, in the embodiment chosen here a piston 4 in the form of an epitrochoid with a pitch circle to base circle ratio of 1:1, and a central housing part 6 with an inner contour provided as a coordinated outer envelope curve is shown. Recognizable in the central housing part 6 are the radial sealing strips 8. The piston has the side sealing rings 10. The piston 4 is rigidly connected with a shaft 12 which shaft is rotatably positioned in the eccentric discs 14 and 16 at 18 and 20. The eccentric discs 14 and 16 are again rotatably positioned in the housing at 22 and 24. It is without significance for the present invention whether friction bearings, needle bearings or ball bearings are used at 18, 20, and 24. The bearings shown serve merely for illustrating the points at which a rotary movement takes place. They may, of course, also assume other functions, for example absorb axial forces, when a corresponding type of bearing or a suitable construction are chosen.

The follow-up of the piston in the housing takes place by means of a pinion 26 which is also rigidly mounted on the shaft 12 and meshes with the inner wheel 28. The absolute values of the divided circle radii of the pinion 26 and the inner wheel 28, as well as the relationship thereof with respect to each other must fulfill certain generally known conditions. For example, in the case of the simplest epitrochoid, the cardioid, the divided circle radius of the pinion is equal to the eccentricity E, i.e. equal to the distance of the center line of the shaft 12 to the main central line of the machine. The divided circle radius of the inner wheel 28 amounts in this case to 2E.

Mounted on the shaft 12 to the right and left hand sides of the piston 4 are the oil splash rings 34 and 36. Due to their rotation, oil — which originates for example from the follower gearing 26 and 28, or the bearing 20 — is flung outwardly because of the centrifugal force, where it flows off through bores (not shown).

The eccentric disc 16 is extended outwardly in the form of a drive shaft 30. The eccentric disc 14 also could have an extension such, for example, as is the case when the machine is intended to transmit a through-drive output.

The housing is constructed in an appropriate manner essentially of disc-shaped elements 32, 52, 6, 62, 72, and 82.

The housing parts are centered, together with the covering plate 38 and the retaining ring 42, by means of set pins (not shown), and are held together by means of throughbolts (not shown).

The division or composition of the housing parts is of no importance to the present invention and must take place according to structural considerations and deliberations having to do with manufacturing techniques. The bearing points are sealed off in a known manner, for example as has been indicated at 38.

The manner of operation of the inventive rotary piston machine of trochoidal construction follows in principle that of known machines with pistons rotatably mounted on the eccentric shaft. The machine shown in FIG. 3 is intended to be driven by way of the shaft 30. The torque applied forces the eccentrically-mounted shaft 12 to move tangentially about the main central axis. This rotating movement has the consequence that the pinion 26 non-rotatably connected with the shaft 12 runs off in the inner wheel 28 and, at that time, sets the shaft 12 into a motion opposite to that of the drive shaft 30. It is for this reason that a bearing must be provided at 20.

The eccentric disc 14 serves for the second support of the rotating parts of the machine. The two eccentric discs 14 and 16 which rotate about the main central line are positioned in the housing, as shown at 22 and 24.

Due to the oppositely rotating movement of the shaft 12, the piston 4 executes the to-and-fro rotary movement which holds it within the constant contact with the radial seals 8 that are required for the operation of the machine.

If necessary, the piston 4 may be connected with the shaft 12 not only non-rotatably, but also rigidly in the axial direction. The absorption of the axial forces takes place, in that case, by way of a fixed bearing, which has not been shown in detail in FIG. 3 as being part of the art and generally known.

It is apparent that, in FIG. 3, the housing part 82 including the eccentric disc 14, and the housing part 72 including the pinion 26 and the inner wheel 28 may be exchanged with respect to each other. In this case, the follower gearing is positioned at the outside of the machine, such as it is known from prior constructions (for example, German Pat. Application P 2,428,327).

Furthermore, it is clearly apparent that the distance of the lubricated parts from the piston may be varied within a wide range, and may be made very large, if such is desirable for the operation of the machine. For example, the housing parts 52 and 62 may be quite readily made very much wider, and their bores may be given a profile pointing away from the piston in order to carry off the oil flung outwardly by the oil splash rings.

It is further apparent that the housing parts 52 and 62 may be made double-walled so that one wall half serves as the side delimitation of the working chambers, and the other wall half as a bearing cover. The oil splash rings then may be positioned between the two wall halves. The interstice then would be provided with an oil drain. In addition, flow medium leaking from this interstice past the piston may be drawn off.

Figure 4:
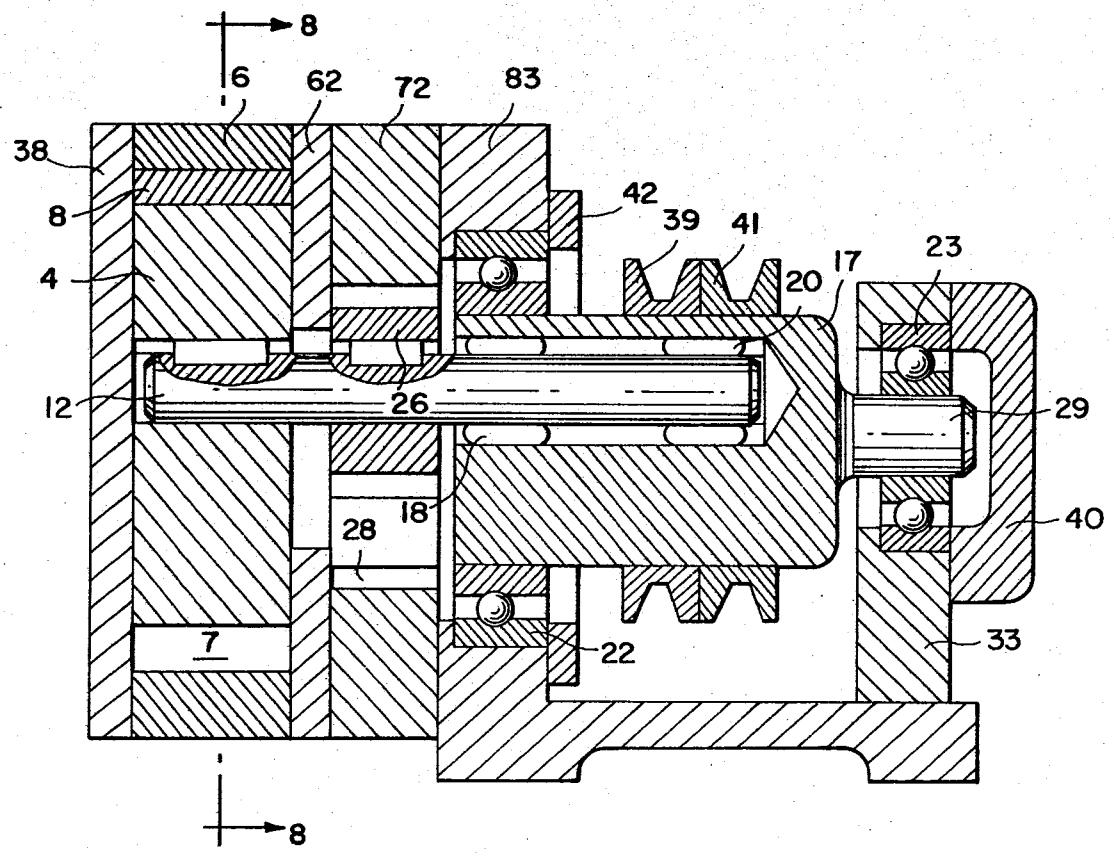
FIG. 4 illustrates an inventive rotary piston machine similar to that shown in FIG. 3, but with a one-sided support of the piston.

FIG. 4 illustrates an inventive rotary piston machine of trochoidal construction with a one-sided support of the piston. The piston 4 has in this case the form of an epitrochoid with a pitch circle to base circle ratio of 1:2, which piston coacts with the central housing part 6, whose inner contour is provided as the coordinated outer envelope curve. In this trochoidal configuration, three contractions are present in the housing in which radial sealing strips 8 are provided. In the cross-section shown in FIG. 4, only one radial sealing strip 8 is visible. On the oppositely-positioned side of the piston, on the other hand, one of the three working chambers of the machine has been indicated, at 7. The working chambers are laterally delimited by a cover plate 38 and a lateral disc 62.

The piston 4 is non-rotatably connected with the shaft 12 which, however, extends in FIG. 4 toward only one piston side. Also non-rotatably connected with the shaft 12 is the pinion 26 which meshes with the inner wheel 28. Because of the trochoid used as a basis, the divided circle ratio of the pinion to the inner wheel is, in this case, 2:3. The shaft 12 is supported in the eccentric disc 17 at 18 and 20 by means of needle bearings. Since the two bearings 18 and 20 of the shaft 12 are positioned closely adjacent each other, they can be housed within a single eccentric disc 17.

It is evident, however, that the one-sided support could be effected also with two separate eccentric discs, for example in that — in FIG. 3 — the housing parts 72 and 82 are positioned at the left of the housing part 32, and the shaft 12 is displaced accordingly toward the left. In this case, the cover plate 38 would replace the housing part 62.

In the case of the one-sided support of the piston and the use of two separate eccentric discs, the pinion and the inner wheel of the follower gearing system may be positioned between them. In this case, the sequence of the housing parts shown in FIG. 3 would be: 38, 6, 62, 32, 72, 82, and 42. This arrangement must be stressed because of the bilateral support of the pinion.

It is further apparent from FIG. 4 that the eccentric disc 17 is supported twice at 22 and 23. The support of the shaft end 29 at 23 permits the use of a smaller bearing.

It is, however, readily possible also to provide in the housing next to the bearing 22 a second one of the same size, and to eliminate the bearing 23. In both cases it is possible that the drive and the power take-off of the machine are effected by way of the shaft end 29, or by way of belt pulleys 39 and 41 which are mounted concentrically to the main center line on the circumference of the eccentric disc 17. In the place of belt pulleys for V-belts or the like, also sprocket wheels or other suitable means may be employed for the transmission of a torsional moment.

FIG. 4 also shows the connection of the bearings 22 and 23 by way of the housing part 83, which also serves as a base plate, and the bearing block 33. The bearing cover shown, 40, is to be provided in the case of a belt or chain drive. If the drive or power takeoff are effected by way of the shaft end 29, the cover plate 40 must be correspondingly bored.

It is readily evident that the drive shown in FIG. 4 with support of the shaft end may be easily transmitted to FIG. 3, in which case then one can eliminate the bearing 24 and a bearing 23 with a bearing block 33 must be provided instead.

FIG. 5 illustrates a rotary piston engine of trochoidal construction according to the present invention, in which the inner contour of the housing is provided as an epitrochoid with a pitch to base circle ratio of 1:2 and the piston as the coordinated inner envelope curve. Here again, the same reference numerals have been used for comparable elements.

The piston 3 is non-rotatably connected to the eccentric shaft 11 which is provided at one end as the eccentric disc 15, and coacts with the central housing part 5. The working chambers in the central housing part 5 are delimited laterally by the lateral discs 52 and 62.

In trochoidal machines with an inner envelope curve, the piston must be rigidly connected with the eccentrically-positioned inner wheel 27 of the follower gearing system. The inner wheel 27 meshes with the pinion 25 being non-rotatably and centrally positioned at the cover plate 38. The disc-shaped end 15 of the shaft 11 is supported at 24 in the housing part 32. The second support of the shaft 11 is effected at 20 in the eccentric disc 16 which is continued, as a drive or driven shaft 30 of the machine. The eccentric disc 16 is supported at 22 in the housing part 82. The bearing 22 is retained in the housing by means of a ring 42 and is rigidly connected in the axial direction with the eccentric disc 16, for example by shrinking it on.

The juxta-positioned housing parts 38, 32, 52, 5, 62, 82, and 42 are centered by set pins (not shown) and are held together by means of through-bolts (not shown). In a manner similar to that shown in FIG. 3, it is possible to also position oil splash rings, shown on the shaft 11 of FIG. 3, to the right and left of the piston. For this purpose, the distance of the oil-lubricated parts from the piston must be increased — for example by widening the side discs 52 and 62.

The machine shown in FIG. 5 operates analogously to the known machines of this type, with the exception that the piston 3 is non-rotatably connected with the eccentric shaft 11. If, for example, a torsional moment is applied by way of the shaft end 30 of the eccentric disc 16, the shaft 11 moves laterally. The inside wheel 27 being rigidly connected therewith meshes with the pinion 25 and thereby turns the shaft 11 and the piston 3 being non-rotatably mounted thereon in a direction opposite to the direction of rotation of the eccentric disc 16. Therewith, the piston 3 executes precisely the same movement as in known machines of this type in which the piston is rotatably mounted on an eccentric.

FIG. 6 illustrates an inventive rotary piston machine with two pistons 4 and 44 of different width. They are non-rotatably connected, i.e., keyed, with the eccentrically-rotatable shaft 12 and are arranged in a desired angular position with respect to each other. It is known from German Offenlegungsschrift, No. 2,339,911, that this is possible, in the mounting of the pistons on a sleeve which is rotatably mounted on a continuous shaft, whenever the coordinated housing parts (in FIG. 6 these are 6 and 66) are pivoted with respect to each other about half the angle as the pistons. The same geometric relationships are present, however, also in the case of an inventive rotary piston machine in which the pistons are non-rotatably mounted on an eccentrically-rotatable shaft 12.

A rotary piston machine with two pistons comprises, typically, a triple-supported eccentrically-rotatable shaft 12. In FIG. 6, this support is at 18 and 20 in friction bearings in the eccentric discs 13 and 16 which are rotatably mounted in the housing at 22 and 24. The third support of the shaft 12 is effected in the thrust crank gear 53, 54 and 55, which serves furthermore as the follower gearing of the two pistons in the housing. This type of follower system may be used only if a pitch to base circle ratio of 1:1 is involved.

The operation of a thrust crank drive as a follower gearing of a rotary piston machine is known from German Offenlegungsschrift No. 2,339,911. The thrust crank drive of FIG. 6 has the crosshead guides 53*x* and 53*y* which point in the *x* and *y* directions, are positioned at a right angle with respect to each other, and are laterally displaced with respect to each other. Mounted on these crosshead guides are the frames 54*x* and 54*y* which are displaceable in the *x* and *y* directions and in which, in turn, the eccentric discs 55*x* and 55*y* are rotatably positioned. These two eccentric discs are non-rotatably connected with the shaft 12. It can be easily seen that the thrust crank drive 53, 54, and 55 — with the eccentric rotation of the shaft 12 — causes an opposite rotary movement in the same manner as an axle-secured pinion which meshes with an inside wheel secured to the housing with a double divided circle radius. It is moreover apparent that the double crosshead guide of the thrust crank drive equals in its effect that of a conventional friction bearing.

The housing is composed of the disc-shaped parts 42, 93, 66, 52, 73, 62, 6, 63, and 43, which are centered by set pins (not shown) and are held together by means of through-bolts (not shown).

The cross-section shown in FIG. 6 is so taken that working chambers are visible for both pistons 4 and 44, namely at 7, 77 and 87.

According to the present invention it is also possible to employ — in a rotary piston machine with only one piston — a thrust crank drive for the follower operation and the eccentric support. This is readily apparent when, for example all parts in FIG. 6 to the left of the side wall 52 are imagined left off, when the shaft 12 is accordingly shortened, and when the perforated side wall 52 is imagined as having been replaced by a cover plate 38. What results then is a double support of the piston 4. Naturally possible is also a one-sided support of the piston 4 in that the thrust crank drives 53, 54, and 55, is positioned between the piston 4 and the eccentric disc 13.

If one eliminates the operation of the thrust crank drive as a support for the shaft 12, it suffices for the follower operation of the piston within the housing to provide only a single crosshead guide, for example 53*x*, on which the frame 54*x* slides, and in which again an eccentric disc 55*x* is rotatably positioned. It is apparent that during rotation of the eccentric discs 13 and 16 by an auxiliary eccentric in the thrust crank drive, the shaft 12 is rotated oppositely.

The cooling of the pistons also becomes readily possible by virtue of the inventive rigid connection of piston and eccentrically-rotating shaft 11, 110, or 12. In FIG. 6, lubricant may be supplied through the channel 201 and a bore 203 in the shaft 12 permits oil to be moved from the channel to the apertures or orifices 205 and 215. These orifices issue into the interior of the piston and transmit the cooling oil. The internal chambers are denoted by numeral 210 with regard to piston 44 and by numeral 220 with regard to piston 4. Once the oil has been made to pass through the interior piston chambers, it flows through the apertures 206 and 216 into the bored drain 204 which is also located in the shaft 12. From there the oil returns through the channel 202 to the oil sump or oil cooler. The sealing rings 207 prevent the oil from leaking.

The lateral limiting walls 52, 62, 63, and 93 are made of double partitions. The corresponding gap is denoted by the numeral 208. Evacuation by suction is effected through the channels 209.

FIG. 6*a* illustrates an embodiment in which the guidance mechanism in the X direction is omitted.

FIG. 7 is a view in cross-section showing the trochoidal shape of the pistons of FIGS. 1, 2, and 2*a*.

It will be obvious to those skilled in the art that many modifications may be made within the scope of the present invention without departing from the spirit thereof, and the invention includes all such modifications.

What is claimed is:

1. In a rotary piston machine of trochoidal construction having a piston mounted on an eccentric shaft in a housing delimited on both sides by side walls, said piston being rotated by a follower means, one part of which is rigidly connected with the piston, the improvement comprising eccentric disc means which balances said machine, two bearing means which are eccentric with respect to each other and one of which bearing means is radially within the other, eccentrically-rotatable shaft means positioned in said eccentric disc means and one of said bearing means, said piston and the part of said follower means rigidly connected therewith being positioned in said housing by said eccentrically-rotatable shaft means, said eccentric disc means being rotatably supported in the other of said bearing means, and means on said eccentric disc means whereby drive or power takeoff of said machine may be effected.

* * * * *